US011686153B2

(12) United States Patent
Chen

(10) Patent No.: US 11,686,153 B2
(45) Date of Patent: Jun. 27, 2023

(54) TOP-DOWN BOTTOM-UP WINDOW COVERING

(71) Applicant: Nien Made Enterprise Co., Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/317,874

(22) Filed: May 11, 2021

(65) Prior Publication Data

US 2022/0205320 A1 Jun. 30, 2022

(30) Foreign Application Priority Data

Dec. 24, 2020 (CN) ..... 202023152965.2

(51) Int. Cl.
*E06B 9/90* (2006.01)
*E06B 9/76* (2006.01)

(52) U.S. Cl.
CPC . *E06B 9/90* (2013.01); *E06B 9/76* (2013.01)

(58) Field of Classification Search
CPC .... E06B 9/32; E06B 9/322; E06B 2009/3222; E06B 9/326; E06B 9/262; E06B 2009/2625; E06B 9/90
See application file for complete search history.

(56) References Cited

U.S. PATENT DOCUMENTS

2005/0217805 A1* 10/2005 Strand ..... E06B 9/60 160/168.1 P
2012/0216968 A1 8/2012 Nakamura
2016/0053534 A1 2/2016 Chang
2017/0260804 A1* 9/2017 Wu ..... E06B 9/68

FOREIGN PATENT DOCUMENTS

JP 2014-31715 A 2/2014
JP 2019-183451 A 10/2019
JP 2019-206888 A 12/2019
JP 2019206888 A * 12/2019
WO 2020/026527 A1 2/2020

* cited by examiner

*Primary Examiner* — Johnnie A. Shablack
*Assistant Examiner* — John W Hanes, Jr.
(74) *Attorney, Agent, or Firm* — Winston Hsu

(57) ABSTRACT

A top-down bottom-up window covering has a headrail, a middle rail, a bottom rail, a lifting control structure installed at the headrail, and a covering structure installed between the middle rail and the bottom rail. The lifting control structure controls a first rotating shaft and a second rotating shaft to respectively receive or release a first cord and a second cord. The first cord drives the middle rail to move, and the second cord drives the bottom rail to move. A one-way clutch and a pre-stress unit are further provided at the headrail. When the bottom rail pushes the middle rail to move upward, the one-way clutch breaks a link between the first rotating shaft and the lifting control structure. Consequently, a driving force generated by the pre-stress unit immediately drives the first rotating shaft to receive the first cord to keep the first cord taut.

12 Claims, 14 Drawing Sheets

TOP-DOWN BOTTOM-UP WINDOW COVERING

BACKGROUND OF THE DISCLOSURE

1. Field of the Disclosure

The present disclosure relates generally to a window covering structure, and more particularly to a top-down bottom-up window covering, of which the revealed or covered area can be changed.

2. Description of the Prior Art

A conventional top-down bottom-up window covering has a headrail, a middle rail, a bottom rail, and a covering structure provided at least between the middle rail and the bottom rail. Two ends of the covering structure are respectively connected to the middle rail and the bottom rail. The middle rail and the bottom rail can be independently moved and stopped in vertical directions through the interactions with different cords, and therefore the covering structure can be adjusted between an extended state and a retracted state. In this way, the areas revealed or covered by the top-down bottom-up window covering can be changed at will.

One kind of conventional top-down bottom-up window covering uses an exposed control cord to manipulate the moving of the middle rail or the bottom rail. The control cord can individually drive a first rotating shaft or a second rotating shaft to rotate, and such operation is realized through a lifting control structure that collaborates with a clutch, a driving device, and a locking device. The first rotating shaft is used to receive or release the cords which drive the middle rail to move, and the second rotating shaft is used to receive or release the cords which drive the bottom rail to move. To decrease the area covered by the covering structure between the middle rail and the bottom rail of the conventional top-down bottom-up window covering, one can control the bottom rail to move upward, by which the bottom rail will eventually reach a position where the covering structure is completely retracted. This is also the position where the bottom rail is closest to the middle rail. However, after the bottom rail has reached the very location, continuously pulling the cords will move the bottom rail to an even higher location, and the middle rail will be further pushed upward. In such a case, the distance between the headrail and the middle rail becomes shorter, and the cords between the headrail and the middle rail used for moving the middle rail are compressed. Since the first rotating shaft is not driven to rotate, the compressed cords will not be correspondingly received to be organized around the first rotating shaft, and therefore will become loose. Such loosen cords may ruin the overall aesthetics of the window covering, and may even damage the window covering if the cords are exposed, tangled, and therefore unable to return to their supposed positions. Furthermore, loose cords could also pose a safety concern.

SUMMARY OF THE DISCLOSURE

In light of the above reasons, one aspect of the present disclosure is to provide a top-down bottom-up window covering, which could ensure that the cords between the headrail and the middle rail can be received and organized when the bottom rail moves upward and pushes the middle rail upward. In this way, the overall aesthetics could be maintained, and the functionality of the window covering could be ensured. Furthermore, there would be no safety concerns, for the cords would not be exposed.

To achieve the above objectives, the present disclosure provides a top-down bottom-up window covering, which comprises a headrail, a middle rail movably provided below the headrail, a bottom rail movably provided below the middle rail, a covering structure provided between the middle rail and the bottom rail, a first rotating shaft provided at the headrail, a second rotating shaft provided at the headrail, a lifting control structure provided at the headrail, a pre-stress unit provided at the headrail, and a one-way clutch located between the first rotating shaft and the lifting control structure. The lifting control structure is adapted to control the first rotating shaft or the second rotating shaft to rotate. The first rotating shaft is adapted to receive or release a first cord, wherein an end of the first cord is fixed at the middle rail; the second rotating shaft is adapted to receive or release a second cord, wherein an end of the second cord is fixed at the bottom rail. The pre-stress unit is concurrently movable along with the first rotating shaft. When the middle rail is pushed upward, the one-way clutch breaks a link between the first rotating shaft and the lifting control structure, and a driving force provided by the pre-stress unit drives the first rotating shaft to receive the first cord.

In an embodiment, the pre-stress unit comprises a spring, which is connected to the first rotating shaft in a concurrently movable manner, whereby the spring accumulates the driving force when the first rotating shaft releases the first cord, and releases the accumulated driving force to urge the first rotating shaft to receive the first cord when necessary.

In an embodiment, the pre-stress unit comprises a sleeve. The spring is connected to the sleeve. The first rotating shaft passes through the sleeve and is concurrently movable along with the sleeve. The spring provides the driving force to the first rotating shaft through the sleeve.

In an embodiment, the pre-stress unit comprises a base case, wherein the sleeve is rotatably provided in the base case. The spring comprises a first end and a second end, wherein the first end is connected to the base case as an unmovable fixing point, and the second end is concurrently movable along with the sleeve.

In an embodiment, the pre-stress unit comprises a base case, and the sleeve is rotatably provided in the base case. The spring comprises an operating portion and a rewinding portion which are concurrently movable along with each other. The rewinding portion is located in the base case, and the operating portion winds around the sleeve with an end of the operating portion connected to the sleeve. The spring provides the driving force to the first rotating shaft through the sleeve.

In an embodiment, the base case comprises a support portion, and the rewinding portion of the spring winds around the support portion.

In an embodiment, the pre-stress unit comprises a base case and a winding shaft. The winding shaft is rotatably provided in the base case. The spring comprises an operating portion and a rewinding portion which are concurrently movable along with each other. The rewinding portion is located in the base case. The operating portion winds around the winding shaft with an end of the operating portion connected to the winding shaft. The winding shaft comprises a first toothed portion provided at an end of the winding shaft, and the sleeve comprises a second toothed portion provided at an end of the sleeve. The first toothed portion engages with the second toothed portion. The spring provides the driving force to the first rotating shaft through the winding shaft which concurrently moves along with the sleeve.

In an embodiment, the base case comprises a support portion provided in the base case, and the rewinding portion of the spring winds around the support portion.

In an embodiment, the top-down bottom-up window covering further comprises a link shaft, wherein an end of the link shaft is connected to the lifting control structure, and two sides of the one-way clutch are respectively connected to the first rotating shaft and the link shaft for engaging or disengaging the first rotating shaft and the lifting control structure.

In an embodiment, the lifting control structure further comprises a control cord which comprises at least a first segment and a second segment. When the first segment of the control cord is dragged, the first rotating shaft is driven to receive the first cord, whereby to lift the middle rail. When the first segment of the control cord is tugged, the first rotating shaft is driven to release the first cord, whereby to lower the middle rail. When the second segment of the control cord is dragged, the second rotating shaft is driven to receive the second cord, whereby to lift the bottom rail. When the second segment of the control cord is tugged, the second rotating shaft is driven to release the second cord, whereby to lower the bottom rail.

In an embodiment, when the first segment of the control cord is dragged, the pre-stress unit accumulates the driving force. When the first segment of the control cord is tugged, the pre-stress unit releases the driving force to the first rotating shaft.

In an embodiment, when the first segment of the control cord is dragged, the one-way clutch engages the lifting control structure and the first rotating shaft for lifting the middle rail. When the middle rail is pushed upward, the one-way clutch disengages the lifting control structure from the first rotating shaft so that the first rotating shaft is driven by the driving force released by the pre-stress unit to receive the first cord.

With the above-mentioned design, the pre-stress unit could provide a driving force to the first rotating shaft, and the driving force could drive the first rotating shaft to rotate correspondingly while the middle rail is being pushed upward by the bottom rail, whereby to receive the cords used for pulling up the middle rail. In this way, the cords could stay taut.

These and other objectives of the present disclosure will no doubt become obvious to those of ordinary skill in the art after reading the following detailed description of the preferred embodiment that is illustrated in the various figures and drawings.

BRIEF DESCRIPTION OF THE DRAWINGS

The present disclosure will be best understood by referring to the following detailed description of some illustrative embodiments in conjunction with the accompanying drawings, in which.

DETAILED DESCRIPTION

Figure 1:
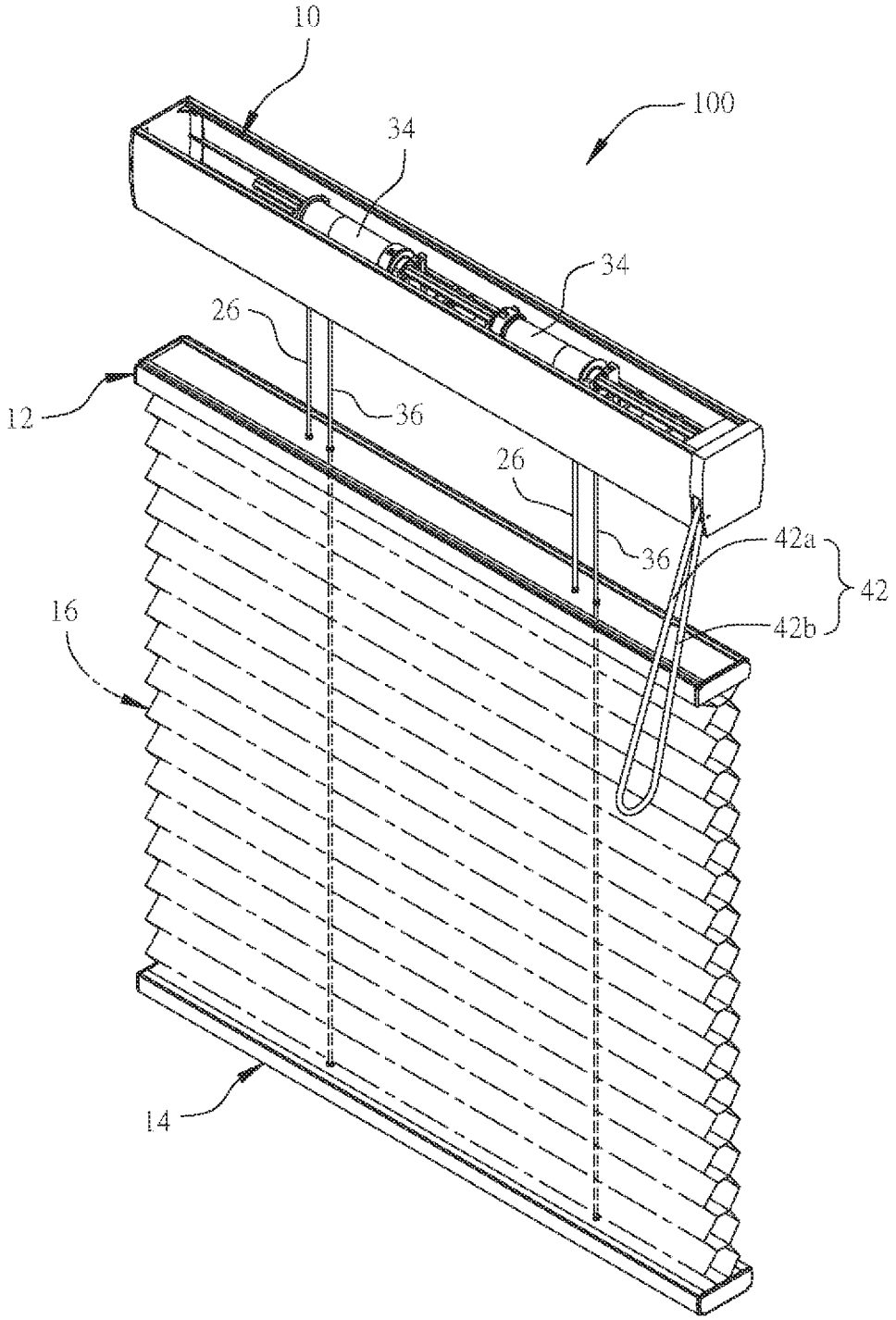
FIG. 1 is a perspective view of a top-down bottom-up window covering implemented according to a first embodiment of the present disclosure.
Figure 2:
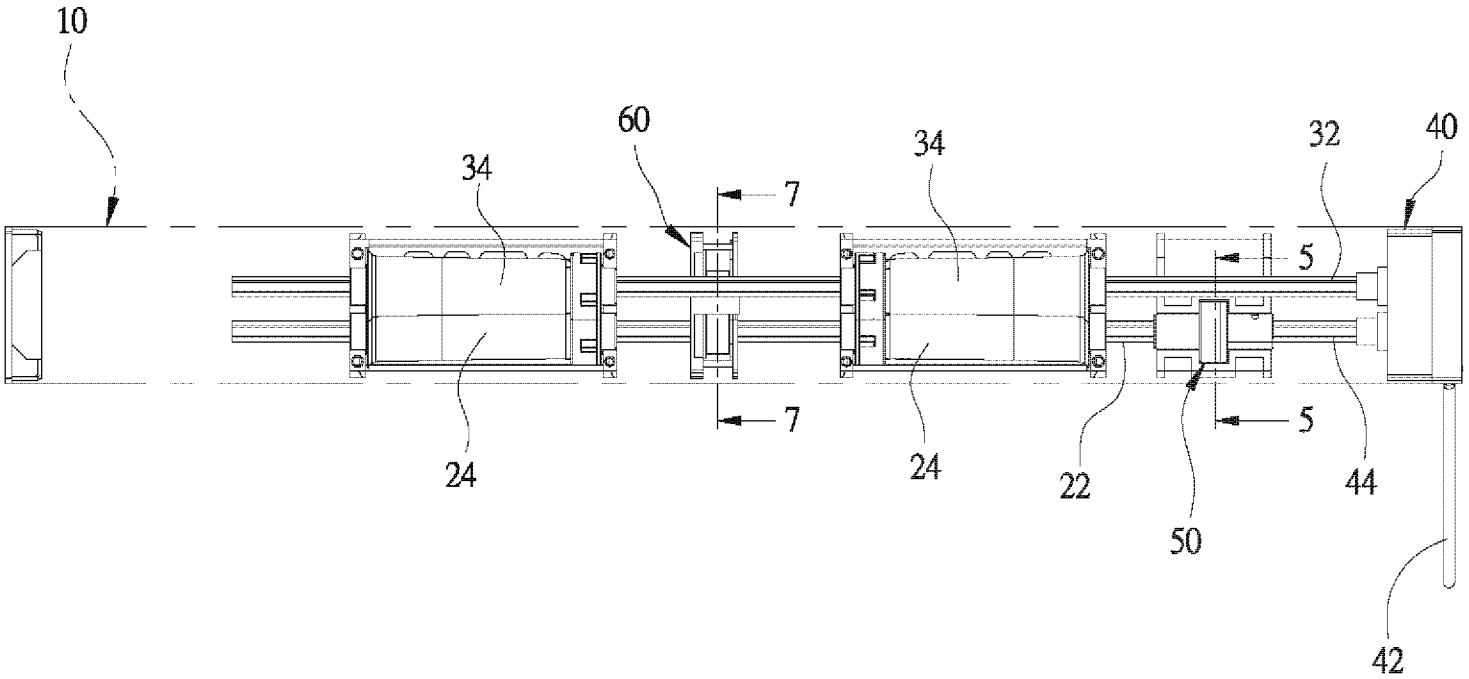
FIG. 2 is a top view of the window covering shown in FIG. 1.
Figure 3:
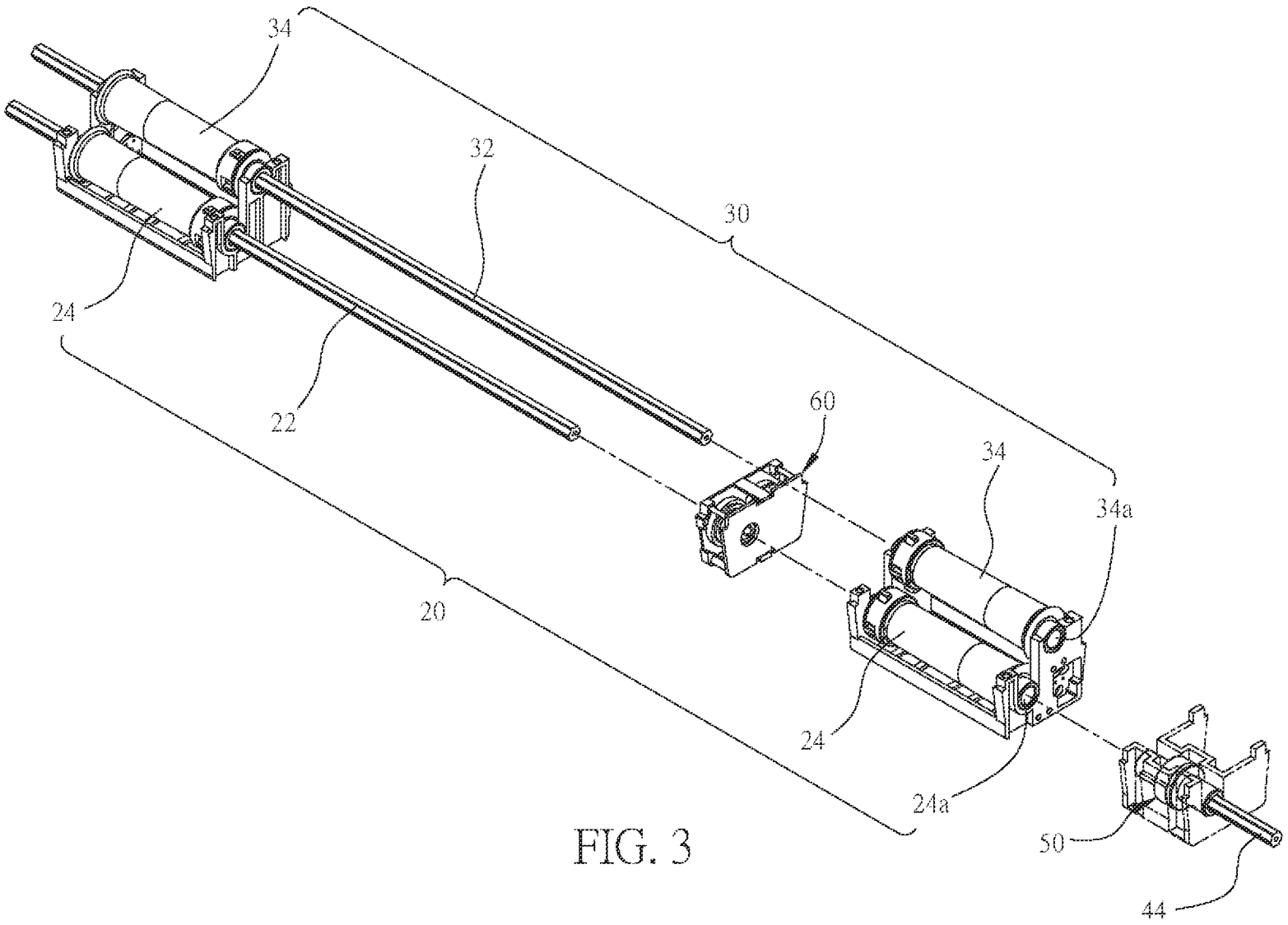
FIG. 3 is an exploded view of part of the components of the window covering shown in FIG. 1.

In order to explain the present disclosure more clearly, the preferred embodiments are described in detail with the accompanying drawings as follows. As shown in FIGS. 1-3, a top-down bottom-up window covering 100 of a first embodiment of the present disclosure comprises a headrail 10, a middle rail 12, a bottom rail 14, and a covering structure 16 provided between the middle rail 12 and the bottom rail 14 to block light out. The covering structure 16 may be realized with, but are not limited to, a blind, a cellular shade, a Roman shade, or a roller shade. In the current embodiment, the covering structure 16 is realized with a cellular shade. Understandably, in another embodiment, there could be another covering structure provided between the middle rail 12 and the headrail 10.

Regarding the headrail 10, please refer to FIGS. 1 and 3. The headrail 10 is usually fixed at an overhead position. The positions of the middle rail 12 and the bottom rail 14 may be respectively configured to adjust the areas revealed or covered by the covering structure 16. Several example implementations and detailed operations of the top-down bottom-up window covering 100 are elaborated below.

The headrail 10 of the top-down bottom-up window covering 100 may be configured to accommodate at least part of a first reeling assembly 20, a second reeling assembly 30, a lifting control structure 40, a one-way clutch 50, and a pre-stress unit 60. In this embodiment, the first reeling assembly 20, the second reeling assembly 30, the lifting control structure 40, the one-way clutch 50, and the pre-stress unit 60 are all provided in the headrail 10.

Regarding the first reeling assembly 20, please refer to FIGS. 2 and 3. The first reeling assembly 20 of the current embodiment comprises a first rotating shaft 22 and two first lift spools 24. The first rotating shaft 22 passes through the two first lift spools 24 in a manner that the first rotating shaft 22 is not freely rotatable relative to the first lift spools 24, so that the first rotating shaft 22 and the first lift spools 24 could be concurrently rotated in the same direction. Each of the first lift spools 24 is connected to a first cord 26, respectively (as shown in FIG. 1). Each of the first cords 26 extends out of the headrail 10 and an end of each of the first cords 26 is fixedly connected to the middle rail 12.

Regarding the second reeling assembly 30, please refer to FIGS. 2 and 3. The second reeling assembly 30 comprises a second rotating shaft 32 and two second lift spools 34. The second rotating shaft 32 passes through the two second lift spools 34 in a manner that the second rotating shaft 32 is not freely rotatable relative to the second lift spools 34, so that the second rotating shaft 32 and the second lift spools 34 could be concurrently rotated in the same direction. Each of the second lift spools 34 is connected to a second cord 36, respectively (as shown in FIG. 1). Each of the second cords 36 extends out of the headrail 10 and passes through the middle rail 12 and the covering structure 16 sequentially. An end of each of the second cord 36 is fixedly connected to the bottom rail 14. In the current embodiment, the first rotating shaft 22 and the second rotating shaft 32 are both polygonal rods. Each of the first lift spools 24 has a polygonal hole 24*a* which allows the first rotating shaft 22 to pass through, and each of the second lift spools 34 has a polygonal hole 34*a* which allows the second rotating shaft 32 to pass through. With such design, the rotating shafts 22, 32 would not be freely rotatable relative to the corresponding lift spools 24, 34, respectively. The polygonal rods 22 and 32 and the corresponding polygonal holes 24*a* and 34*a* may be respectively configured to have same or different shapes, e.g., triangular rods to triangular holes, rectangular rods to rectangular holes, and other suitable combinations of polygonal rods and holes.

The lifting control structure 40 may be realized with many suitable structures, e.g., the lift control structures disclosed in U.S. patent applications Ser. Nos. US20120216968A1 and US20160053534A1. Therefore, the detailed structures of the lifting control structure 40, e.g., a driver, a clutch and a locking device, are not illustrated in the figures. The lifting control structure 40 is installed at a side of the headrail 10, and is adapted to control the first rotating shaft 22 and the second rotating shaft 32 to rotate. Rotating the first rotating shaft 22 would drive the first lift spools 24 to receive or release the first cords 26, and rotating the second rotating shaft 32 would drive the second lift spools 34 to receive or release the second cords 36. In the current embodiment, the lifting control structure 40 comprises a control cord 42, at least part of which is exposed out of the headrail 10. Both ends of the control cord 42 are connected to the driver, the clutch and/or other component of the lifting control structure 40 for controlling the first rotating shaft 22 and the second rotating shaft 32. The control cord 42 has a first segment 42*a* and a second segment 42*b*, and the first segment 42*a* and the second segment 42*b* are on different segments (e.g., front and rear segments) of the control cord 42. Through the cooperation with the driver and the clutch of the lifting control structure 40, the first rotating shaft 22 and the second rotating shaft 32 could be independently controlled to rotate by pulling the first segment 42*a* or the second segment 42*b* of the control cord 42 downward (or, to put it another way, by pulling the control cord 42 in different directions), so that the first lift spools 24 and the second lift spools 34 could be selectively driven to rotate. In this way, either the first cords 26 or the second cords 36 could be received for changing the position of the middle rail 12 or the bottom rail 14. When the control cord 42 is no longer being pulled, a locking device (not shown) of the lifting control structure 40 would restrict the first rotating shaft 22 and/or the second rotating shaft 32 from rotating, whereby to ensure that the middle rail 12 and the bottom rail 14 stays at their present positions.

Figure 4:
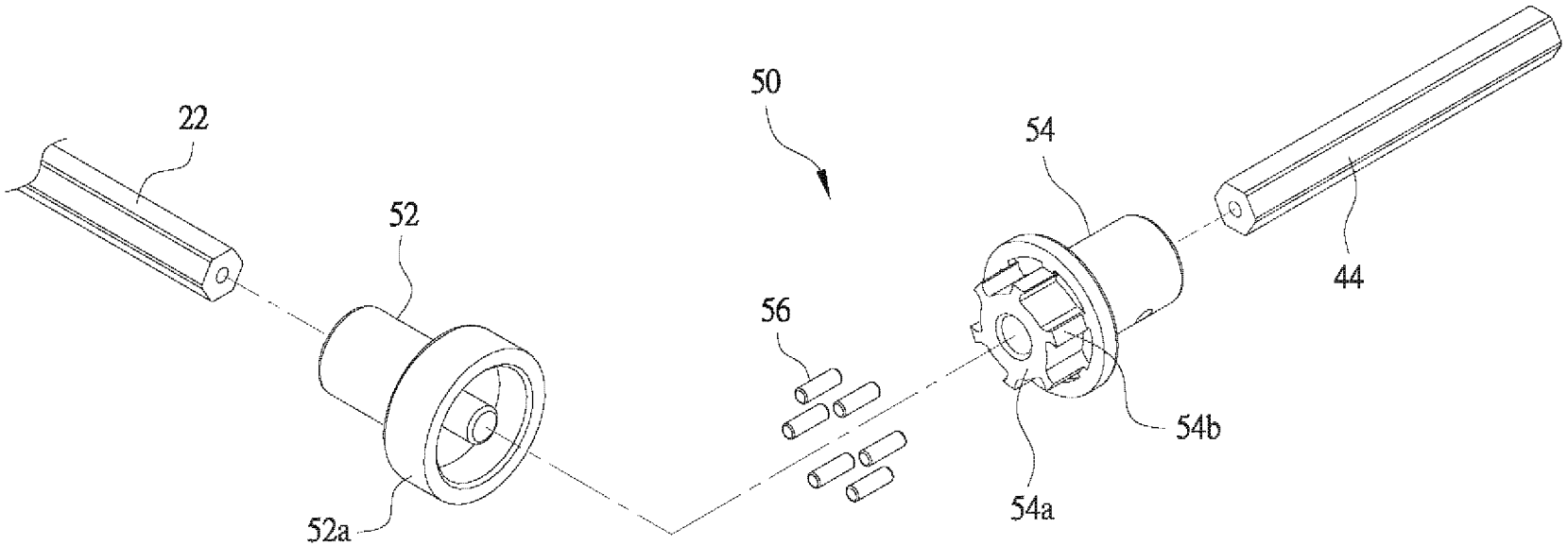
FIG. 4 is an exploded view of the one-way clutch shown in FIG. 3.

Regarding the one-way clutch 50, please refer to FIGS. 2-4. In the current embodiment, a first end of the one-way clutch 50 is connected to the first rotating shaft 22 and a second end of the one-way clutch 50 is connected to the lifting control structure 40 through a link shaft 44. The link shaft 44 may be implemented as a polygonal rod, which has a first end and a second end respectively connected to the lifting control structure 40 and the one-way clutch 50, and therefore the link shaft 44 is concurrently rotatable along with the lifting control structure 40. The one-way clutch 50 may be utilized to configure the first rotating shaft 22 and the link shaft 44 to rotate concurrently or independently. The detailed structures of the one-way clutch 50 will be elaborated below.

In the first embodiment, when the bottom rail 14 is lifted to push the middle rail 12 upward through the covering structure 16, the pre-stress unit 60 collaborates with the one-way clutch 50 for receiving the first cords 26 between the headrail 10 and the middle rail 12. The first cords 26 between the headrail 10 and the middle rail 12 may therefore remain taut. The detailed structures of the pre-stress unit 60 will be elaborated below.

The operations of the top-down bottom-up window covering 100 are further explored below through the detailed descriptions regarding the first reeling assembly 20, the second reeling assembly 30, the lifting control structure 40, the one-way clutch 50 and the pre-stress unit 60.

In the present embodiment, a user could tug or drag the first segment 42*a* and the second segment 42*b* of the control cord 42 to move the middle rail 12 and the bottom rail 14. Both the tugging and dragging should be done with a moderate force. In this disclosure, "tugging" refers to the action of a quick pull in a certain direction over a relatively short distance, and "dragging" refers to the action of a constant pull in a certain direction over a relatively long distance. Specifically, when the middle rail 12 or the bottom rail 14 are at relatively high positions, a user could tug the first segment 42*a* to lower the middle rail 12 or tug the second segment 42*b* to lower the bottom rail 14. Or, put it in another way, a user could lower the middle rail 12 or the bottom rail 14 by tugging the control cord 42 in different directions. On the other hand, when the middle rail 12 or the bottom rail 14 are at relatively low positions, a user could drag the first segment 42*a* to lift the middle rail 12 or drag the second segment 42*b* to lift the bottom rail 14. Similarly, the operation could be described as dragging the control cords 42 in different directions as well. In practice, the top-down bottom-up window covering 100 may be configured in another manner that the operations are done in the opposite way. Specifically, in one of such embodiments, when the middle rail 12 or the bottom rail 14 are at relatively high positions, a user could tug the second segment 42*b* to lower the middle rail 12 or tug the first segment 42*a* to lower the bottom rail 14; on the other hand, when the middle rail 12 or the bottom rail 14 are at relatively low positions, a user could drag the second segment 42*b* to lift the middle rail 12 or drag the first segment 42*a* to lift the bottom rail 14.

In the present embodiment, when the first segment 42*a* of the control cord 42 is tugged, the locking device of the lifting control structure 40 removes the restriction upon the first rotating shaft 22 and the first rotating shaft 22 could rotate freely. The first rotating shaft 22 is therefore driven by the weight of the middle rail 12 (and maybe part of the weight of the covering structure 16 and the bottom rail 14) to rotate, and the first cords 26 would be released from the first lift spools 24 to lower the middle rail 12 to a desired location. Moreover, when the second segment 42*b* of the control cord 42 is tugged, the locking device of the lifting control structure 40 removes the restriction upon the second rotating shaft 32 and the second rotating shaft 32 could rotate freely. The second rotating shaft 32 is therefore driven by the weight of the bottom rail 12 to rotate, and the second cords 36 would be released from the second lift spools 34 to lower the bottom rail 14 to a desired location.

Herein a rotating direction of the lift spools which receives the cords is defined as a receiving rotating direction, and a rotating direction of the lift spools which releases the cords is defined as a releasing rotating direction. The lifting control structure may be manual operated and/or driven by one or more motors. In the current embodiment, one single lifting control structure is provided on a single side of the headrail 10 capable of controlling the middle rail 12 and the bottom rail 14. In another embodiment, there could be two lifting control structures respectively provided on the same side or different sides of the headrail 10 to respectively control the middle rail 12 and the bottom rail 14.

The interactions among the rotating shafts 22 and 32, the lifting control structure 40, the one-way clutch 50 and the pre-stress unit 60 are further explored below.

When the middle rail 12 is not pushed by the bottom rail 14 and the control cord 42 is either dragged or not operated, the first rotating shaft 22 engages with the lifting control structure 40 through the link shaft 44 and the one-way clutch 50, i.e., the lifting control structure 40 may restrict the link shaft 44 from moving or drive the link shaft 44 to rotate in the receiving rotating direction. Moreover, the weight of the middle rail 12 (and the weight of a part of the covering structure 16 which is suspended below the middle rail 12 but not supported by the bottom rail 14) would constantly provide a force which urges the first rotating shaft 22 to rotate in the releasing rotating direction opposite to the receiving rotating direction. Thus, the first cords 26 may remain taut when the control cord 42 is dragged or not operated.

When the middle rail 12 is not pushed by the bottom rail 14 and the control cord 42 is tugged, the first rotating shaft 22 disengages from the lifting control structure 40 through the one-way clutch 50. The weight of the middle rail 12 and the part of the covering structure 16 which is not supported by the bottom rail 14 would drive the first rotating shaft 22 to rotate in the releasing rotating direction opposite to the receiving rotating direction, which would also drive the first lift spools 24 provided around the first rotating shaft 22 to rotate simultaneously to release the first cords 26 wound thereon. Thus, the first cords 26 may still remain taut when the control cord 42 is tugged.

Moreover, the pre-stress unit 60 provides a driving force in a direction opposite to the weight of the middle rail 12 and the covering structure 16 exerting on the first lift spools 24 and the first rotating shaft 22. Specifically, the driving force provided by the pre-stress unit 60 would urge the first lift spools 24 and the first rotating shaft 22 to rotate in the receiving rotating direction, while the weight of the middle rail 12 and the covering structure 16 would urge the first lift spools 24 and the first rotating shaft 22 to rotate in the releasing rotating direction. In the process of lowering the middle rail 12 or lifting the bottom rail 14, before the bottom rail 14 interferes with the middle rail 12, the middle rail 12 is hung by the first cords 26 and the first cords 26 remains taut for bearing the weight of the middle rail 12 and the covering structure 16. When the bottom rail 14 interferes with the middle rail 12, the first cords 26 becomes loose and the driving force provided by the pre-stress unit 60 would drive the first lift spools 24 and the first rotating shaft 22 to rotate in the receiving rotating direction till the first cords 26 restore taut. Thus, the first cords 26 may remain taut when the control cord 42 is tugged, dragged and not operated. Moreover, the first cords 26 may also restore taut even if the bottom rail 14 interferes with the middle rail 12.

Furthermore, the second rotating shaft 32 is connected to the lifting control structure 40 without the one-way clutch 50. The weight of the bottom rail 14 and a part of the covering structure 16 which is supported by the bottom rail 14 would constantly provide a force which urges the second rotating shaft 32 to rotate in the releasing rotating direction opposite to the receiving rotating direction, which would also urge the second lift spools 34 provided around the second rotating shaft 32 to release the second cords 36 wound thereon. Thus, the second cords 36 may remain taut whether the control cord 42 is tugged, dragged, or not operated.

An embodiment of the one-way clutch 50 and the interactions with other components are explored below.

Figure 5:
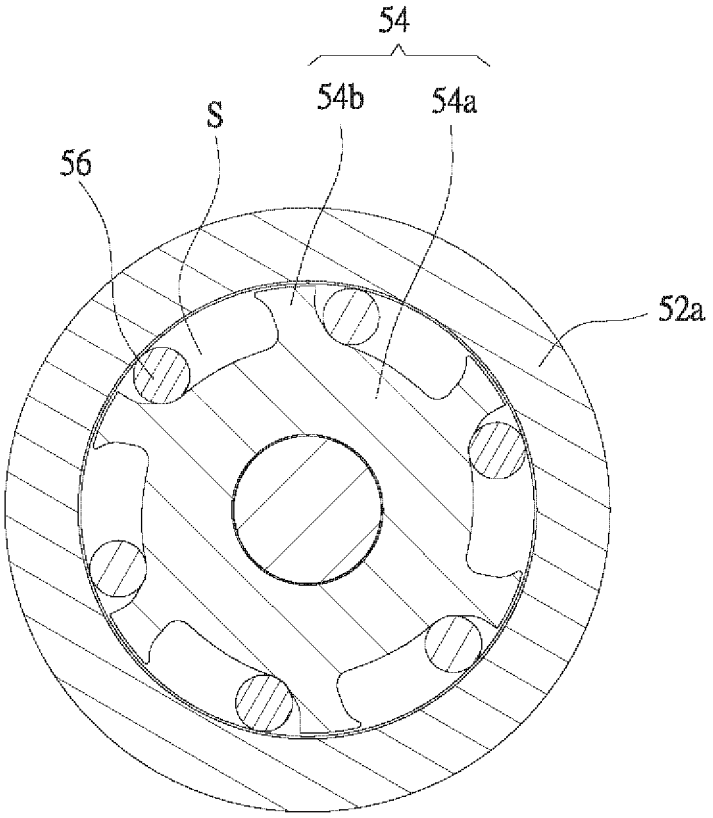
FIG. 5 is a sectional view along the 5-5 line in FIG. 2.

As shown in FIGS. 4-5, in the current embodiment, the one-way clutch 50 used to realize the above-mentioned operation comprises an outer tube 52, an inner tube 54, and a plurality of rotating rods 56. The outer tube 52 and the inner tube 54 are coupled in a manner that they are rotatable relative to each other, and the rotating rods 56 are provided between the outer tube 52 and the inner tube 54. Specifically, the outer tube 52 has a polygonal hole at a first end to receive an end of the first rotating shaft 22, so that the outer tube 52 could rotate concurrently along with the first rotating shaft 22. The outer tube 52 has a circular wall 52*a* formed at a second end of the outer tube 52. The inner tube 54 has a polygonal hole at a first end to receive the link shaft 44, so that the inner tube 54 could rotate concurrently along with the link shaft 44. The inner tube 54 has a column 54*a* formed at a second end of the inner tube 54, wherein the column 54*a* has a plurality of ribs 54*b* formed on a periphery of the column 54*a*. As shown in FIG. 5, when the inner tube 54 and the outer tube 52 are coupled, the column 54*a* of the inner tube 54 is located in the circular wall 52*a* of the outer tube 52, and an inner side of the circular wall 52*a* and every two neighboring ribs 54*b* have a space S formed therebetween, which is wedge-shaped in the current embodiment. In other words, each of the spaces S has two ends of different sizes, and each of the rotating rods 56 is correspondingly located in one of the spaces S. In another embodiment, the spaces S may also be realized with spaces of other suitable shapes, and the spaces S are not necessary to have a uniform shape.

When the link shaft 44 is restricted from moving by the locking device of the lifting control structure 40, the inner tube 54 also remains unmovable. On the other hand, when the link shaft 44 is concurrently moved by the driver of the lifting control structure 40 to rotate in the receiving rotating direction, which drives the inner tube 54 to rotate in the same direction. The rotating rods 56 are forced to lean against the ribs 54*b* which are close to the smaller ends of the spaces S, and tightly abuts against the inner side of the circular wall 52*a* and the periphery of the column 54*a*, as shown in FIG. 5, which is because the weight of the middle rail 12 (and the weight of the part of the covering structure 16 which is suspended below the middle rail 12 without being supported by the bottom rail 14) permanently provides a force to urge the first rotating shaft 22 to rotate in the releasing rotating direction opposite to the receiving rotating direction. At this time, the positions of the rotating rods 56 in the spaces S make the inner tube 54 and the outer tube 52 unable to have a relative rotation, i.e., the inner tube 54 cannot rotate in the first rotating direction and the outer tube 52 cannot rotate in the second rotating direction. However, the inner tube 54 and the outer tube 52 would still hold such tendency therebetween, i.e., the inner tube 54 would still intend to rotate in the first rotating direction, while the outer tube 52 would still intend to rotate in the second rotating direction.

As a result, the one-way clutch 50 would be in an engaged state which could transmit forces. In other words, with the one-way clutch 50 in the engaged state, if the link shaft 44 is restricted by the locking device of the lifting control structure 40, the user could control the link shaft 44 to rotate in the receiving rotating direction by dragging the control cord 42. The dragging force would be transmitted to the first rotating shaft 22 through the inner tube 54 and the outer tube 52 of the one-way clutch 50 and the link shaft 44, which would make the first rotating shaft 22 rotate in the receiving rotating direction as well. Whereby, the first cords 26 could be received. On the contrary, after the locking device of the lifting control structure 40 removes the restriction applied on the link shaft 44, the user could also release the first cords 26.

It could be understood from the above description that, when the rotating rods 56 lean against the ribs 54*b* close to the smaller ends of the spaces S, like the condition shown in FIG. 5, the one-way clutch 50 would be in the engaged state that could transmit forces as aforementioned. The engaged state means that the inner tube 54 and the outer tube 52 of the one-way clutch 50 would no longer have a relative rotation, whereby the first rotating shaft 22 and the link shaft 44 could have and maintain a linked relationship. When the rotating rods 56 lean against the ribs 54*b* which are close to the larger ends (i.e., the other ends of the spaces S) of the spaces S, the one-way clutch 50 would be in a disengaged state which breaks the link. The disengaged state means that the inner tube 54 and the outer tube 52 of the one-way clutch 50 could be independently rotated in a manner that the inner tube 54 goes in the second rotating direction or the outer tube 52 goes in the first rotating direction, so that the linked relationship between the first rotating shaft 22 and the link shaft 44 could be broken.

Several embodiments of the pre-stress unit 60 and the interactions with other components are explored below.

Figure 6:
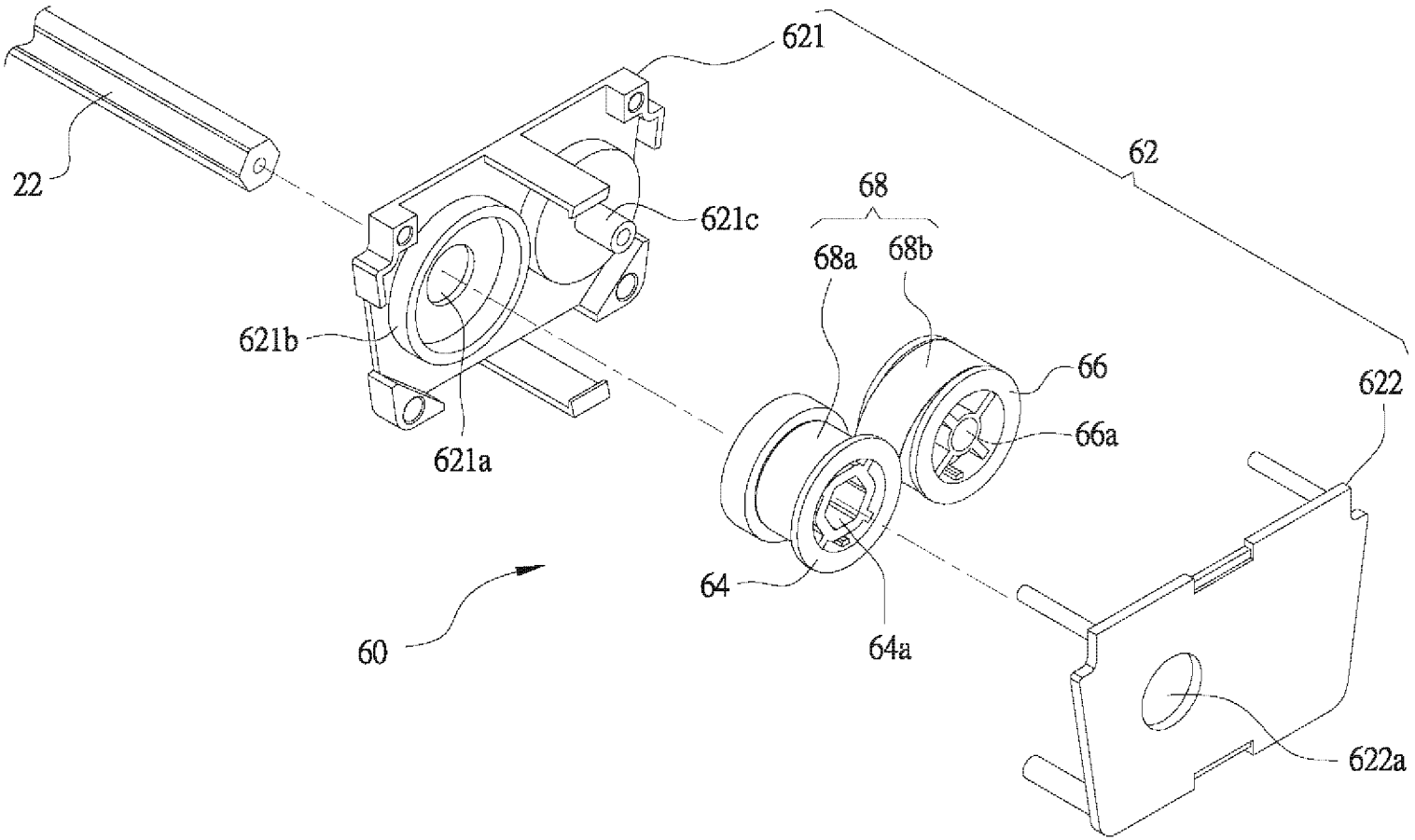
FIG. 6 is an exploded view of the pre-stress unit shown in FIG. 3.
Figure 7:
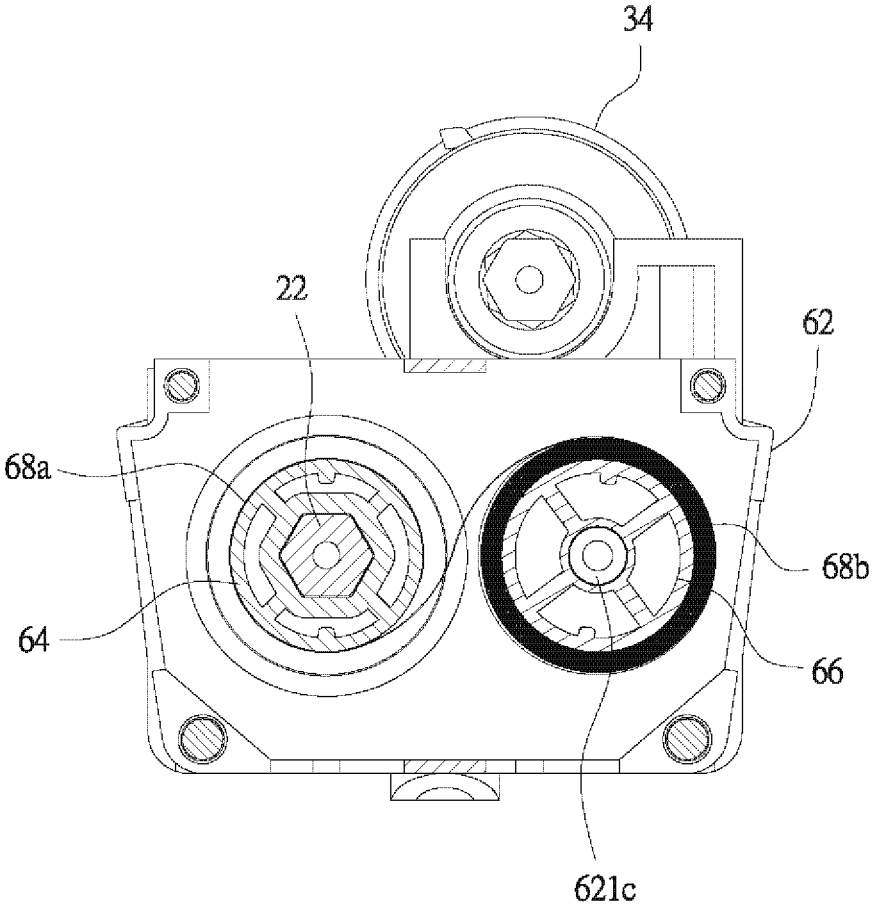
FIG. 7 is a sectional view along the 7-7 line in FIG. 2.

According to the first embodiment of the present disclosure, the pre-stress unit 60 could provide a driving force, which is in the receiving rotating direction, to the first rotating shaft 22 of the first reeling assembly 20. As shown in FIGS. 6 and 7, the pre-stress unit 60 of the current embodiment, which is used to achieve the aforementioned objective, comprises a base case 62, a sleeve 64, an idler 66, and a spring 68. The base case 62 is formed by assembling and engaging a first shell 621 and a second shell 622 which are separable from each other. The first shell 621 has a through hole 621*a*, and the second shell 622 has a through hole 622*a* as well. The first shell 621 has a protruding blocking wall 621*b* formed on an inner side of the first shell 621 around an outer periphery of the through hole 621*a*, and has a support portion which comprises a column 621*c* protruding at a position near the blocking wall 621*b*. The sleeve 64 and the idler 66 are both tubular, and respectively have an axial bore 64*a* and an axial bore 66*a*. While shapes of the through hole 621*a* and the through hole 622*a* do not interfere with a cross-section of the first rotating shaft 22, a shape of the axial bore 64*a* matches a profile of the cross-section of the first rotating shaft 22, so that the sleeve 64 and the first rotating shaft 22 could rotate concurrently. The spring 68 is S-shaped and wound between the sleeve 64 and the idler 66. Specifically, an end of the spring 68 is connected to the sleeve 64, and the other end of the spring 68 may be fixed at the idler 66 or encircle the idler 66. Herein a part of the spring 68 winding around the sleeve 64 is defined as an operating portion 68*a*, and another part of the spring 68 winding around the idler 66 is defined as a rewinding portion 68*b*, wherein the operating portion 68*a* and the rewinding portion 68*b* are linked and concurrently movable along with each other. In other words, the operating portion 68*a* and the rewinding portion 68*b* are different parts of the spring 68 winding around different components (i.e., the sleeve 64 and the idler 66, respectively). Since the operating portion 68*a* and the rewinding portion 68*b* together constitute the spring 68, the movement of each of the portions 68*a*, 68*b* would bring the other one of the portions 68*a*, 68*b* to move and change the winding counts (i.e., the number of turns it takes for winding) of each of the portions 68*a*, 68*b*. As the first rotating shaft 22 rotates, the amount of the first cords 26 received around the first lift spools 24 would be changed, and the winding counts of the operating portion 68*a* and the rewinding portion 68*b* would be also concurrently changed. Specifically, when the winding counts of the operating portion 68*a* increase, the winding counts of the winding portion 68*b* will decrease, and vice versa. With such design, the spring 68 could accumulate a rewinding pulling force when the first rotating shaft 22 is rotating in the direction of receiving the first cords 26, and could release the accumulated rewinding pulling force to exert on the sleeve 64 when necessary, wherein the rewinding puling force serves as the driving force of the pre-stress unit 60 mentioned above.

The rewinding pulling force (i.e., the driving force) of the spring 68 is exerted on the first lift spools 24 and the first rotating shaft 22 in a direction opposite to that caused by the weight of the middle rail 12 and the covering structure 16. Specifically, the rewinding pulling force would urge the first lift spools 24 and the first rotating shaft 22 to rotate in the receiving rotating direction, while the weight of the middle rail 12 and the covering structure 16 would urge the first lift spools 24 and the first rotating shaft 22 to rotate in the releasing rotating direction. The rewinding pulling force of the spring 68 could be designed to be less than the weight of the middle rail 12 (or less than a total weight of the middle rail 12 and part of the covering structure 16). Whereby, when the user tugs the control cord 42 to lower the middle rail 12 (i.e., when the restriction applied by the locking device of the lifting control structure 40 to the link shaft 44 is removed), the middle rail 12 could be ensured to be able to descend as its own weight (or the total weight combined with part of the covering structure 16) would surpass the rewinding pulling force of the pre-stress unit 60. In this way, once the restriction applied by the locking device of the lifting control structure 40 to the link shaft 44 is removed, the first cords 26 could be successfully released.

Please refer to FIG. 6 again. Herein, the assembly of the pre-stress unit 60 is further specified. The sleeve 64, which already has the spring 68 wound thereon, is placed in an area circled by the blocking wall 621*b*, the column 621*c* of the support portion passes through the axial bore 66*a* of the idler 66. Then, the second shell 622 and the first shell 621 are engaged through snap-fitting. In this way, the sleeve 64 and the idler 66 could be rotatably located in the base case 62, and the pre-stress unit 60 could be modularized.

The first rotating shaft 22 of the first reeling assembly 20 sequentially passes through one of the first lift spools 24, the through hole 621*a* of the first shell 621 of the pre-stress unit 60, the axial bore 64*a* of the sleeve 64, the through hole 622*a* of the second shell 622, and then the other one of the first lift spools 24. The end of the first rotating shaft 22 is engaged with the one-way clutch 50. The pre-stress unit 60 of the current embodiment is installed between the two first lift spools 24. To suit different circumstances, the pre-stress unit 60 could be also installed on an outer side of any one of the first lift spools 24 in another embodiment.

Based on the above descriptions, when the user drags the control cord 42 to lift the bottom rail 14 and the middle rail 12 is not yet pushed, the middle rail 12 is hung by the first cords 26. During this period, the first cords 26 are taut for bearing the weight of the middle rail 12 and part of the covering structure 16 below it. The weight of the middle rail 12 and part of the covering structure 16 would balance the rewinding pulling force of the spring 68 of the pre-stress unit 60, so that the rewinding pulling force would be insufficient to drive the sleeve 64 to rotate the first rotating shaft 22.

However, if the user keeps dragging the control cord 42 to further lift the bottom rail 14, the middle rail 12 will be pushed upward, and the total weight exerted on the first cords contributed by the middle rail 12 itself and the covering structure 16 suspended below will reduce. In other words, the rewinding pulling force of the spring 68 of the pre-stress unit 60 is sufficient to overcome the total weight of the middle rail 12 and the covering structure 16 exerted on the first cords 26. The link shaft 44 is restricted by the locking device of the lifting control structure 40 from rotating, and the rewinding pulling force released from the spring 68 of the pre-stress unit 60 exerted on the sleeve 64 would drive the first rotating shaft 22 and the first lift spools 24 to rotate in the receiving rotating direction. The first rotating shaft 22 and the link shaft 44 would create a relative rotation, and therefore the outer tube 52 and the inner tube 54, which are respectively concurrently movable along with the first rotating shaft 22 and the link shaft 44, would create a relative rotation as well. Furthermore, this relative rotation would force the rotating rods 56 of the one-way clutch 50 to be driven to abut against the ribs 54*b* at the larger ends of the adjacent spaces S, so that the one-way clutch 50 would be switched from the engaged state that could transmit forces to the disengaged state that breaks the link. So far, although the link shaft 44 is still restricted by the locking device of the lifting control structure 40, the inner tube 54 and the outer tube 52 of the one-way clutch 50 could independently rotate. Therefore, the rewinding pulling force provided by the spring 68 of the pre-stress unit 60 could drive the sleeve 64 to rotate in the receiving rotating direction, which would urge the first rotating shaft 22 and the first lift spools 24 to rotate in the receiving rotating direction to receive the first cords 26. The aforementioned mechanism could improve the defect that the cords between the headrail and the middle rail of conventional structures have unwanted loose segments when the middle rail is pushed upward by the bottom rail. Hence, the structures of the present disclosure could receive the segments of the first cords 26 between the headrail 10 and the middle rail 12 if the middle rail 12 is being pushed, which could keep the first cords 26 taut. The embodiments could maintain the overall aesthetic appearance of the window covering, reduce the possibility of damaging the window covering due to the tangle of the exposed cords, and therefore eliminate safety concerns.

The description above regards the top-down bottom-up window covering 100 of the first embodiment of the present disclosure, and the pre-stress unit 60 disclosed in the first embodiment comprises the S-shaped, winding spring 68, wherein the winding counts of the operating portion 68*a* and the rewinding portion 68*b* of the spring 68 could be changed as the sleeve 64 is driven to rotate by the first rotating shaft 22, whereby to accumulate the driving force required for driving the sleeve 64 to rotate. However, in practice, the structural implementation of the pre-stress unit is not limited to that mentioned above, and could at least be realized with other suitable structures.

Figure 8:
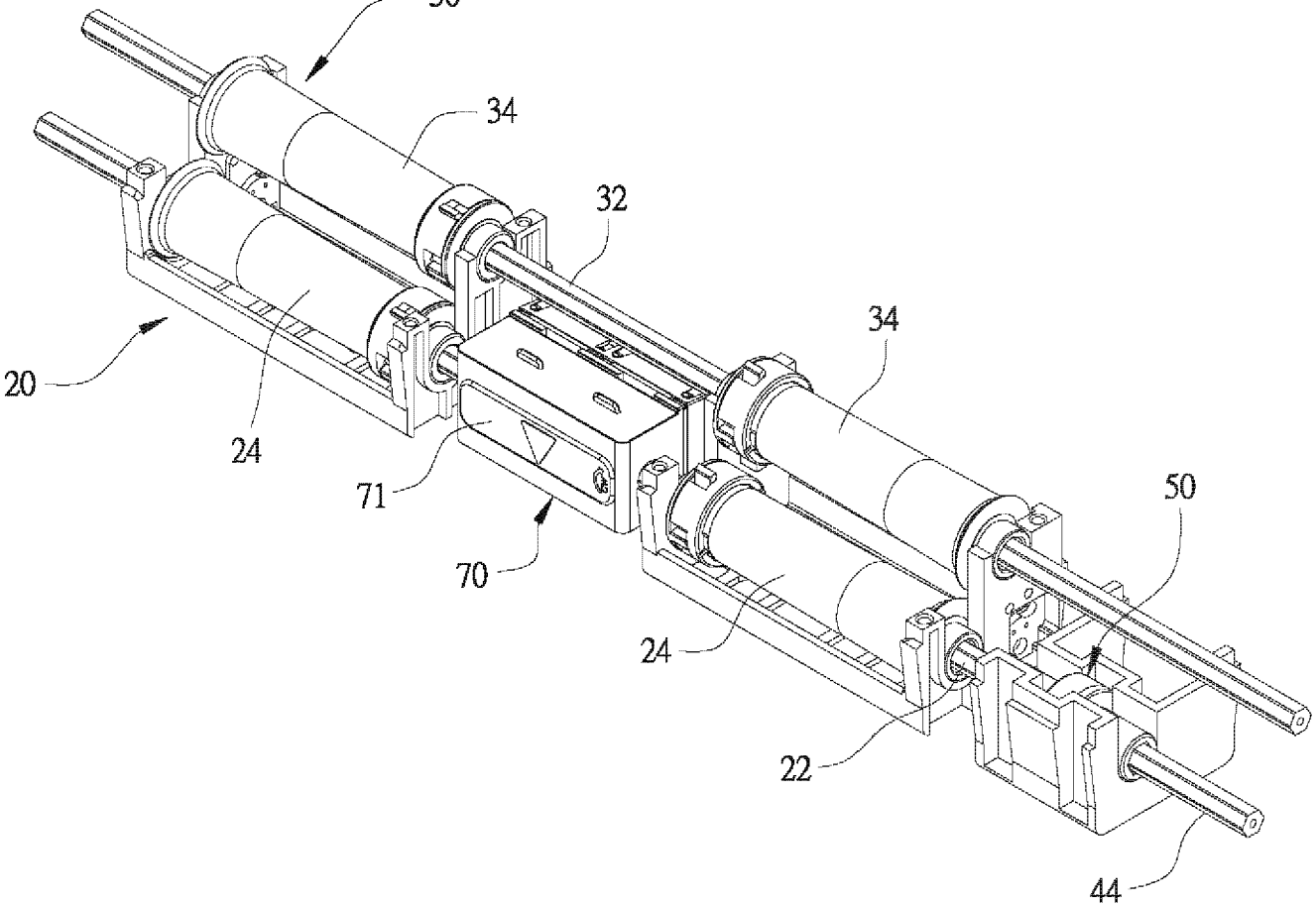
FIG. 8 is a perspective view showing another type of the pre-stress unit and the reeling assembly, which are implemented according to a second embodiment of the present disclosure.
Figure 9:
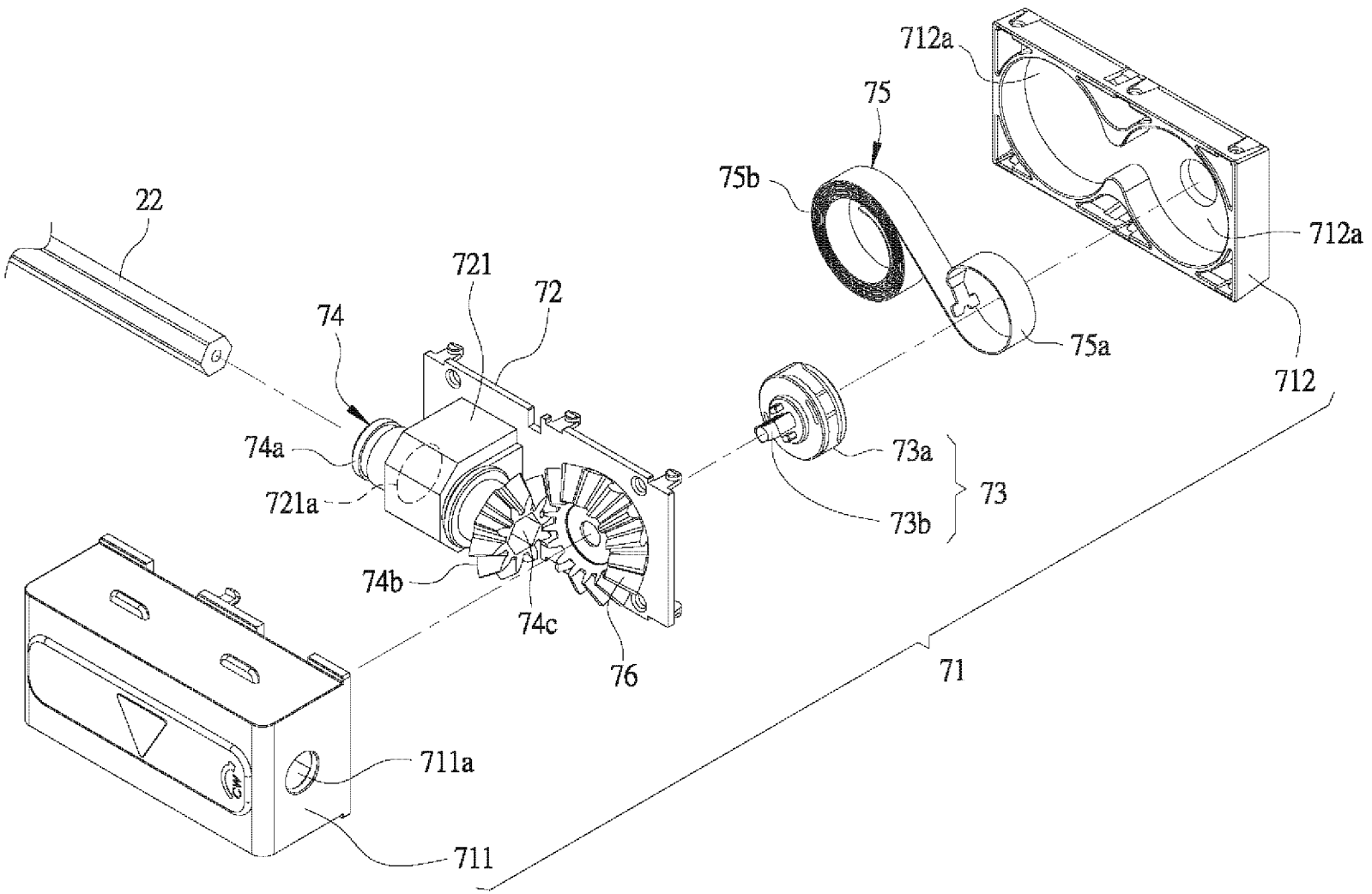
FIG. 9 and FIG. 10 are perspective exploded views of the pre-stress unit shown in FIG. 8 viewed from different view angles.
Figure 10:
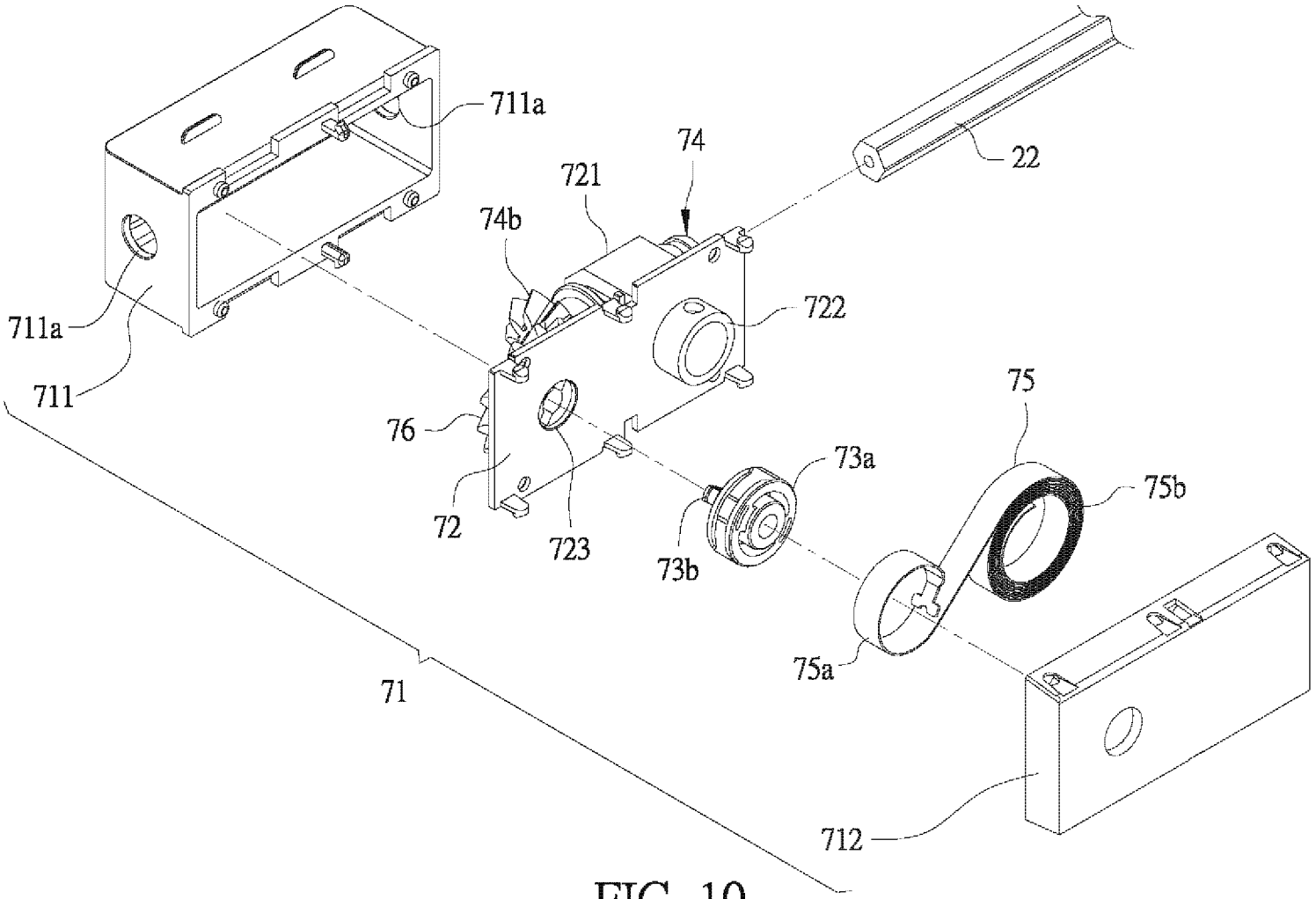

FIGS. 8-10 disclose a second embodiment of the pre-stress unit. FIG. 8 discloses the relative position relationship between another type of pre-stress unit 70, the first reeling assembly 20, and the second reeling assembly 30. The reeling assemblies 20 and 30 may be realized with the same or similar structures provided in the previous first embodiment. The pre-stress unit 70 is also installed between the two first lift spools 24, and is adapted to create the driving force to rotate the first rotating shaft 22 when the weight of the middle rail 12 (and the weight of the covering structure 16) exerted on the first rotating shaft 22 reduces. As shown in FIG. 9 and FIG. 10, the pre-stress unit 70 comprises a base case 71, a fixed seat 72, a winding shaft 73, a sleeve 74, and a spring 75. The base case 71 is formed by assembling and engaging a case body 711 and a side cover 712. The case body 711 has a receiving space formed in the case body 711, and two corresponding through holes 711*a* formed on side walls of the case body 711, respectively. The side cover 712 has two round receiving recesses 712*a* formed on a side wall facing the case body 711. The fixed seat 72 is provided between the case body 711 and the side cover 712, and has a shaft holder 721 and a tube 722 formed on two opposite sides of the fixed seat 72, respectively. The shaft holder 721 has a receiving hole 721*a*, and the tube 722 is a support portion. In addition, the fixed seat 72 further has a through hole 723.

The winding shaft 73 of the pre-stress unit 70 has a round disc 73*a* and a rotating shaft 73*b*, wherein the rotating shaft 73*b* is formed by extending outward from a rotating center of the round disc 73*a*. The winding shaft 73 uses the rotating shaft 73*b* of the winding shaft 73 to pass through the through hole 723 of the fixed seat 72, and the rotating shaft 73*b* is fixedly connected to a first toothed portion 76 which comprises a bevel gear. The first toothed portion 76 is located at an end of the winding shaft 73, and is on the side of the fixed seat 72 having the shaft holder 721. On the other hand, the round disc 73*a* is on the other side of the fixed seat 72 having the tube 722. The winding shaft 73 is fixedly connected to the first toothed portion 76, and these two components can be concurrently rotated. The sleeve 74 has a tube portion 74*a* and a second toothed portion 74*b*, which is connected to an end of the tube portion 74*a* and comprises a bevel gear. The sleeve 74 has an axial bore 74*c* passing through the tube portion 74*a* and the second toothed portion 74*b*. The tube portion 74*a* of the sleeve 74 passes through the receiving hole 721*a* of the shaft holder 721 of the fixed seat 72 in a rotatable manner. The sleeve 74 and the second toothed portion 74*b* can be rotated concurrently. The second toothed portion 74*b* engages with the first toothed portion 76, so that the sleeve 74 and the winding shaft 73 are located in the base case 71 in a concurrently rotatable manner.

The structure of the spring 75 is the same as or similar to that of the spring 68 of the first embodiment, and also has an operating portion 75*a* and a rewinding portion 75*b* which are concurrently movable along with each other. The operating portion 75*a* winds around the round disc 73*a* of the winding shaft 73 with an end of the operating portion 75*a* connected to the round disc 73*a*, and the rewinding portion 75*b* winds around the tube 722 of the fixed seat 72. Similarly, the rotation of the first rotating shaft 22 could change the winding counts of the operating portion 75*a* and the rewinding portion 75*b*, whereby to accumulate a corresponding driving force to drive the winding shaft 73 to rotate.

The sleeve 74 and the first toothed portion 76 of the assembled pre-stress unit 70 are located in the receiving space of the case body 711, wherein the operating portion 75*a* and the rewinding portion 75*b* of the spring 75 are respectively located in the corresponding receiving recesses 712*a* of the side cover 712. The first rotating shaft 22 passes through the through hole 711*a* of the case body 711 and the axial bore 74*c* of the sleeve 74. The through hole 711*a* does not hinder the rotation of the first rotating shaft 22, but the first rotating shaft 22 and the axial bore 74*c* are arranged in a manner that these two components cannot freely rotate relative to each other. With such design, when the middle rail 12 is pushed, the rewinding pulling force (i.e., the driving force) provided by the spring 75 of the pre-stress unit 70 would drive the winding shaft 73 to rotate. The rotating winding shaft 73 would then drive the sleeve 74 to rotate through the engagement between the first toothed portion 76 and the second toothed portion 74*b*. Similarly, the first rotating shaft 22 would concurrently rotate along with the sleeve 74 in the receiving rotating direction, which would make the first lift spools 24 receive the first cords 26. In this way, when the weight of the middle rail 12 (and the weight of the covering structure 16 carried thereon) reduces, the segments of the first cords 26 between the headrail 10 and the middle rail 12 could be received and restore taut.

Figure 11:
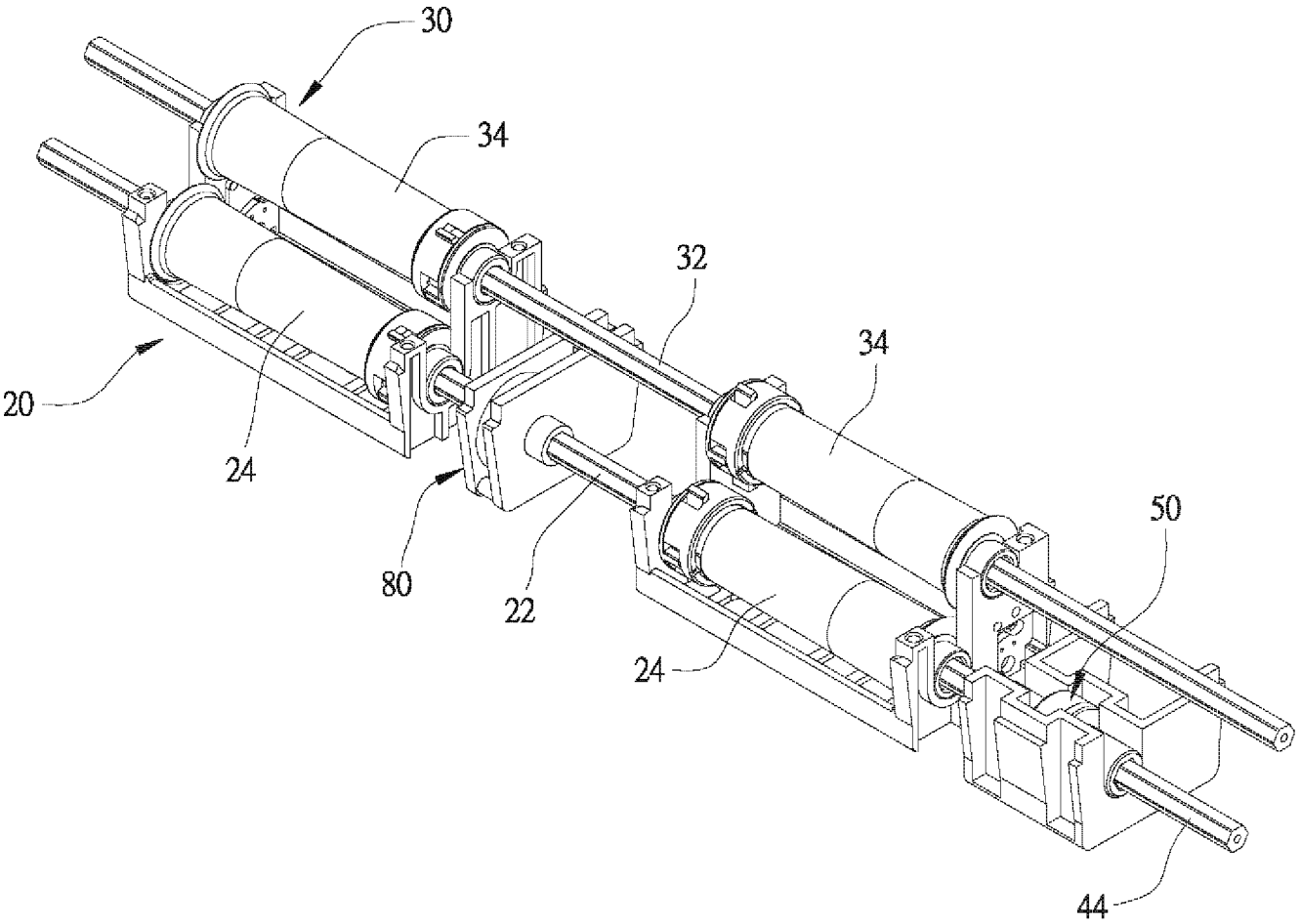
FIG. 11 is a perspective view of still another type of the pre-stress unit and the reeling assembly, which are implemented according to a third embodiment of the present disclosure.
Figure 12:
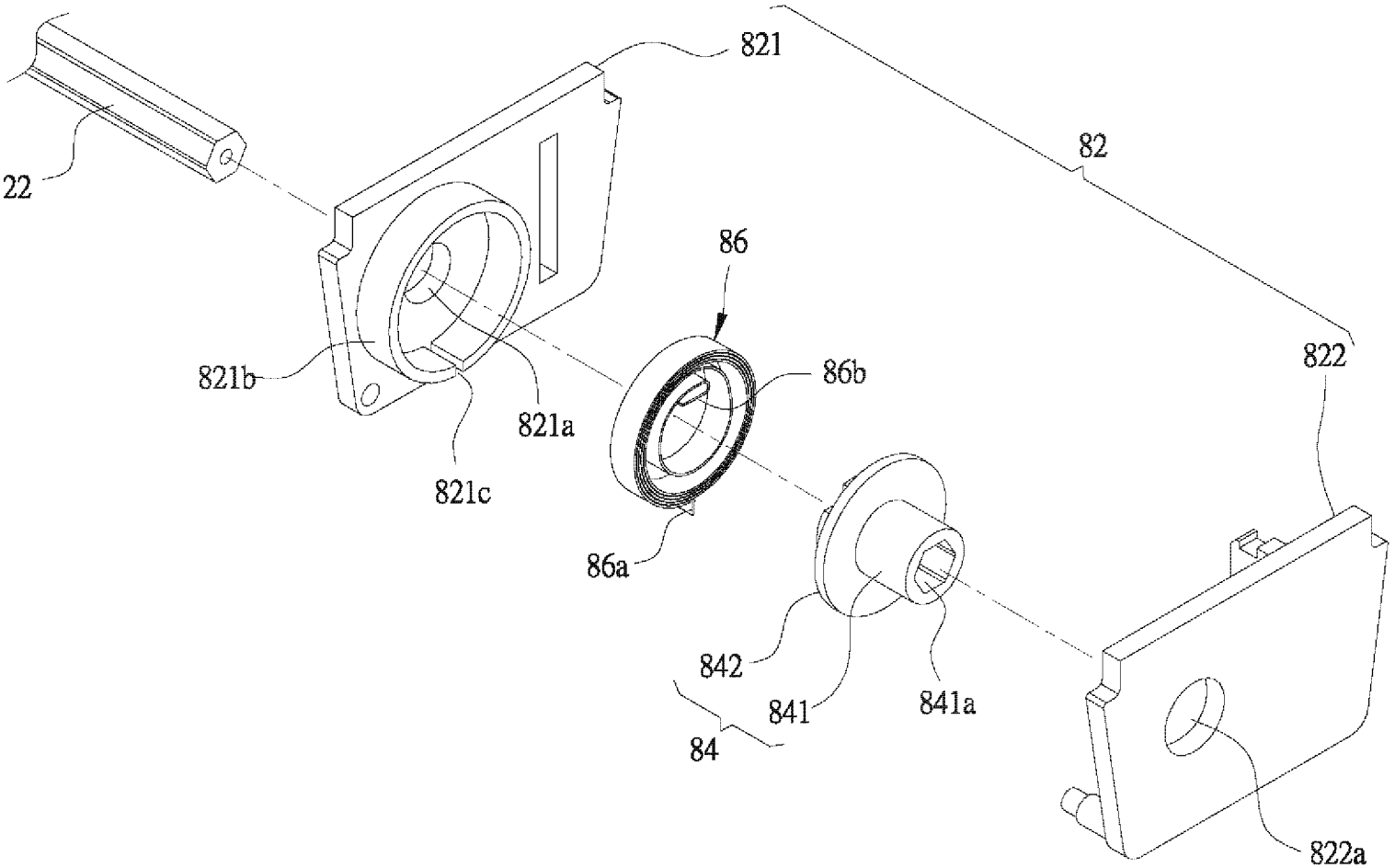
FIG. 12 and FIG. 13 are perspective exploded views of the pre-stress unit shown in FIG. 11 viewed from different view angles.
Figure 13:
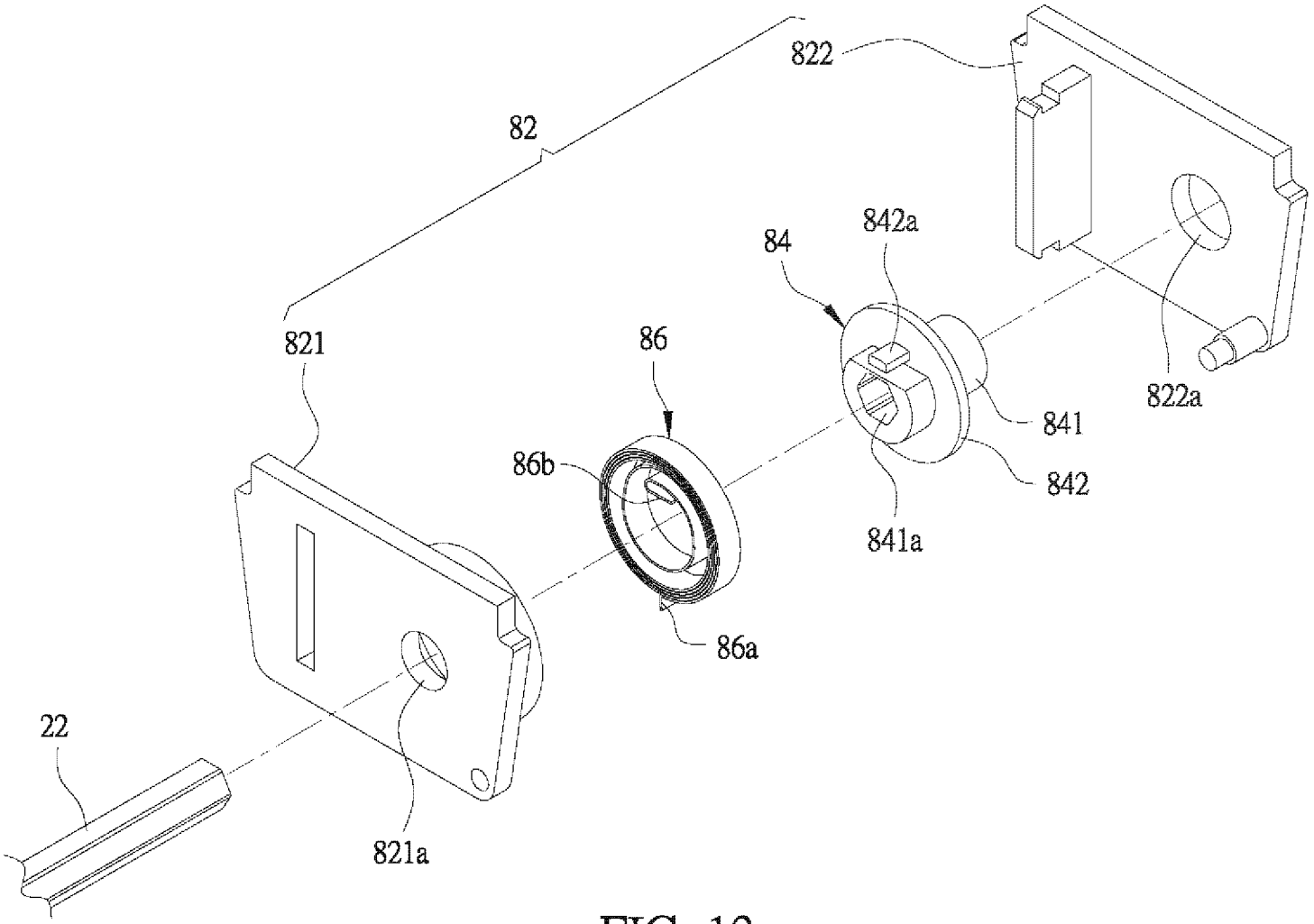
Figure 14:
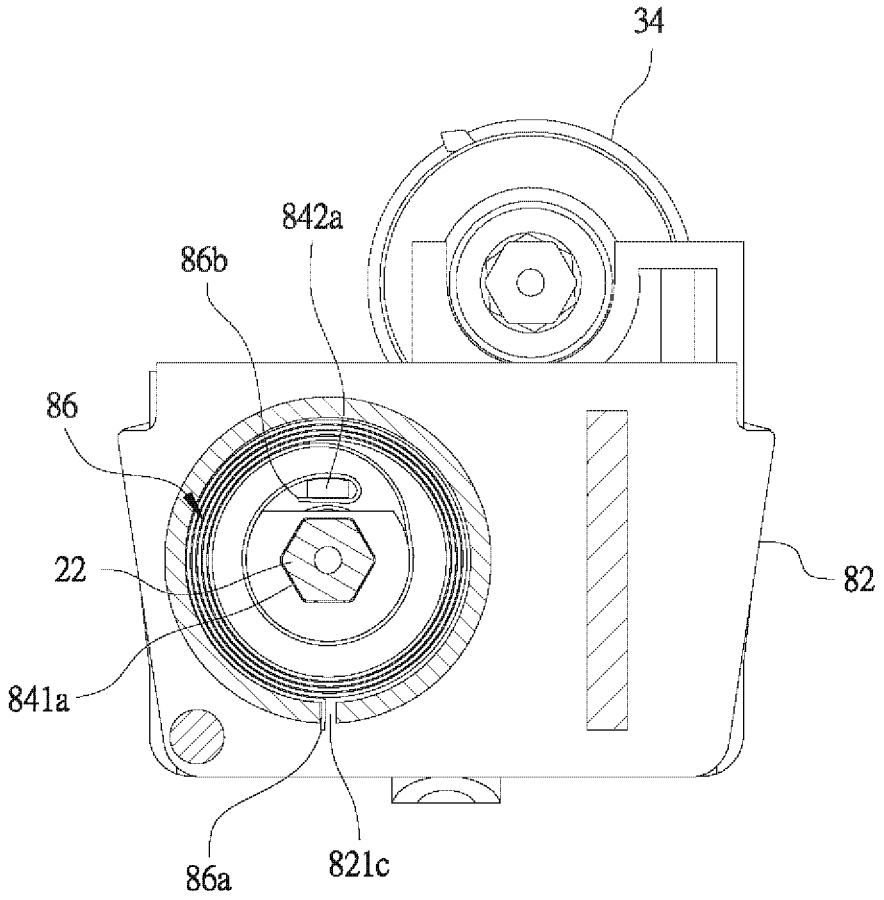
FIG. 14 is a sectional view of the pre-stress unit shown in FIG. 11.

FIGS. 11-14 show a third embodiment of the pre-stress unit. FIG. 11 discloses the relative position relationship between a pre-stress unit 80, the first reeling assembly 20 and the second reeling assembly 30. The reeling assemblies 20 and 30 may by realized with the same or similar structures provided in the previous first embodiment. The pre-stress unit 80 is also installed between the two first lift spools 24, and is adapted to create the driving force to rotate the first rotating shaft 22 when the weight of the middle rail 12 (and the weight of the covering structure 16) exerted on the first rotating shaft 22 reduces. As shown in FIGS. 12 and 13, the pre-stress unit 80 comprises a base case 82, a sleeve 84, and a spring 86. The base case 82 is formed by assembling and engaging a first shell 821 and a second shell 822. The first shell 821 and the second shell 822 respectively have a through hole 821*a* and a through hole 822*a*, wherein shapes of the through hole 821*a* and the through hole 822*a* do not interfere with the profile of the cross-section of the first rotating shaft 22, so that the first rotating shaft 22 could freely rotate in the through hole 821*a* and the through hole 822*a*. The first shell 821 has a protruding blocking wall 821*b* formed on an inner side of the first shell 821 around an outer periphery of the through hole 821*a*, wherein the blocking wall 821*b* has a notch 821*c*. The sleeve 84 has an axial tube 841 having an axial bore 841*a*, and an outer periphery of the axial tube 841 is connected to a round disc 842, which has a positioning block 842*a* on a side surface of the round disc 842. The spring 86 has a first end 86*a* and a second end 86*b*, wherein the first end 86*a* is connected to the base case 82 as an unmovable fixing point, and the second end 86*b* is concurrently movable along with the sleeve 84. As shown in FIG. 14, the spring 86 of the current embodiment is a scroll spring which winds around an external portion of a part of the axial tube 841, and is located within an area encircled by the blocking wall 821*b*. The first end 86*a* of the spring 86 fits into and fixed to the notch 821*c* of the blocking wall 821*b*. The second end 86*b* of the spring 86 is bent to hook the positioning block 842*a*. With such design, the rewinding pulling force accumulated by the spring 86 could exert on the sleeve 84.

The first rotating shaft 22 passes through the through hole 821*a* on the base case 82, the axial bore 841*a*, and the through hole 822*a*. The first rotating shaft 22 and the axial bore 841*a* are arranged in a manner that these two components cannot freely rotate relative to each other. With such design, when the middle rail 12 is pushed, the rewinding pulling force (i.e., the driving force) provided by the spring 86 of the pre-stress unit 80 would drive the sleeve 84 and the first rotating shaft 22 to rotate concurrently in the receiving rotating direction. The first cords 26 could be received and restore taut.

In summary, it should be understood that the present disclosure uses the springs 68, 75, 86 of each of the embodiments to provide the rewinding pulling force to the first rotating shaft 22, whereby to urge the first rotating shaft 22 to rotate in the receiving rotating direction that the first lift spools 24 may receive the first cords 26. Furthermore, the one-way clutch 50 would stay in the engaged state when the middle rail 12 is naturally hung (i.e., not pushed), so that the link shaft 44 and the first rotating shaft 22 could remain concurrently movable along with each other. As a result, the user could change the position of the middle rail 12 as required by operating the first lift spools 24 to receive or release the first cords 26 through the lifting control structure 40. If the movement of the bottom rail 14 further lifts the middle rail 12 so that the weight of the middle rail 12 and the covering structure 16 exerted on the first lift spools 24 and the first rotating shaft 22 reduces, the driving force provided by the springs 68, 75, 86 of the pre-stress unit 60, 70, 80 in each of the embodiments would drive the first rotating shaft 22 to rotate in the receiving rotating direction, and the one-way clutch 50 would be switched to a disengaged state to break the link between the first rotating shaft 22 and the link shaft 44. In this way, the rotation of the first rotating shaft 22 could be ensured not to be restricted by the locking device of the lifting control structure 40, and therefore the driving force of the pre-stress unit may drive the first rotating shaft 22 and the first lift spools 24 to receive the first cords 26 so that the first cords 26 would remain taut.

Based on the objectives aforementioned, the effect of the structures of the pre-stress units 60, 70, 80 in each of the embodiments is to make the springs 68, 75, 86 and the first rotating shaft 22 have a steady and linked arrangement, so that the springs 68, 75, 86 could correspondingly accumulate or release the rewinding pulling force when the middle rail 12 is operated by the lifting control structure 40. Furthermore, when the middle rail 12 is pushed, the springs 68, 75, 86 could smoothly output the driving force to receive the loose part of the first cords 26. In addition, the various implementations described above are designed for adapting to different space arrangement requirements of the headrail 10. Therefore, any structural arrangements with the same function, including different means of fixing or forming components or structures, should be considered as belonging to an equivalent scope. Furthermore, the same concept should also be applied to structures having no idler for winding the rewinding portions 68*b*, 75*b* of the springs 68, 75, or any design that uses the base case to form corresponding space to confine the rewinding portions 68*b*, 75*b*. The springs 68, 75, 86 can be a constant force spring or a variable force spring, which should be understood not a limitation of the present disclosure, but a choice to meet different design requirements. Understandably, there are many and varied kinds of one-way clutch capable of providing the same or similar function, and therefore the one-way clutch 50 disclosed in the aforementioned embodiments is not a limitation of the present disclosure; other conventional one-way clutches should all be considered technically equivalent. The control cord 42 can be made of other suitable materials in other embodiments. For example, the control cord 42 could be made of a tape, a strip, a ribbon, a band, or other suitable materials.

It must be pointed out again that the embodiments described above are only some preferred embodiments of the present disclosure. All equivalent structures which employ the concepts disclosed in this specification and the appended claims should fall within the scope of the present disclosure. Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A top-down bottom-up window covering, comprising:

a headrail;

a middle rail, which is movably provided below the headrail;

a bottom rail, which is movably provided below the middle rail;

a covering structure provided between the middle rail and the bottom rail;

a first rotating shaft, which is provided at the headrail and is adapted to receive or release a first cord, wherein an end of the first cord is fixed at the middle rail;

a second rotating shaft, which is provided at the headrail and is adapted to receive or release a second cord, wherein an end of the second cord is fixed at the bottom rail;

a lifting control structure provided at the headrail and adapted to control the first rotating shaft or the second rotating shaft to rotate;

a pre-stress unit, which is provided at the headrail and is concurrently movable along with the first rotating shaft; and a one-way clutch, which is located between the first rotating shaft and the lifting control structure;

wherein, when the middle rail is pulled upward by the first cord, the one-way clutch is in an engaged state for keeping a link between the first rotating shaft and the lifting control structure;

when the middle rail is not pushed and not pulled upward by the first cord, and the bottom rail is lifted, the one-way clutch is in the engaged state for keeping the link between the first rotating shaft and the lifting control structure;

when the middle rail is pushed upward, the one-way clutch is in a disengaged state for breaking the link between the first rotating shaft and the lifting control structure, and a driving force provided by the pre-stress unit drives the first rotating shaft to receive the first cord.

2. The top-down bottom-up window covering of claim 1, wherein the pre-stress unit comprises a spring, which is connected to the first rotating shaft in a concurrently movable manner, whereby the spring accumulates the driving force when the first rotating shaft releases the first cord, and releases the accumulated driving force to urge the first rotating shaft to receive the first cord when the middle rail is pushed upward.

3. The top-down bottom-up window covering of claim 2, wherein the pre-stress unit comprises a sleeve; the spring is connected to the sleeve; the first rotating shaft passes through the sleeve and is concurrently movable along with the sleeve; the spring provides the driving force to the first rotating shaft through the sleeve.

4. The top-down bottom-up window covering of claim 3, wherein the pre-stress unit comprises a base case; the sleeve is rotatably provided in the base case; the spring comprises a first end and a second end, wherein the first end is connected to the base case for becoming an unmovable fixing point, and the second end is concurrently movable along with the sleeve.

5. The top-down bottom-up window covering of claim 3, wherein the pre-stress unit comprises a base case; the sleeve is rotatably provided in the base case; the spring comprises an operating portion and a rewinding portion which are concurrently movable along with each other; the rewinding portion is located in the base case; the operating portion winds around the sleeve with an end of the operating portion connected to the sleeve; the spring provides the driving force to the first rotating shaft through the sleeve.

6. The top-down bottom-up window covering of claim 5, wherein the base case comprises a support portion, and the rewinding portion of the spring winds around the support portion.

7. The top-down bottom-up window covering of claim 3, wherein the pre-stress unit comprises a base case and a winding shaft; the winding shaft is rotatably provided in the base case; the spring comprises an operating portion and a rewinding portion which are concurrently movable along with each other; the rewinding portion is located in the base case; the operating portion winds around the winding shaft with an end of the operating portion connected to the winding shaft; the winding shaft comprises a first toothed portion provided at an end of the winding shaft, and the sleeve comprises a second toothed portion provided at an end of the sleeve; the first toothed portion engages with the second toothed portion; the spring provides the driving force to the first rotating shaft through the winding shaft which concurrently moves along with the sleeve.

8. The top-down bottom-up window covering of claim 7, wherein the base case comprises a support portion provided in the base case, and the rewinding portion of the spring winds around the support portion.

9. The top-down bottom-up window covering of claim 1, further comprising a link shaft, wherein an end of the link shaft is connected to the lifting control structure, and two sides of the one-way clutch are respectively connected to the first rotating shaft and the link shaft for engaging or disengaging the first rotating shaft and the lifting control structure.

10. The top-down bottom-up window covering of claim 1, wherein the lifting control structure further comprises a control cord which comprises at least a first segment and a second segment; when the first segment of the control cord is dragged, the first rotating shaft is driven to receive the first cord, whereby to lift the middle rail; when the first segment of the control cord is tugged, the first rotating shaft is driven to release the first cord, whereby to lower the middle rail; when the second segment of the control cord is dragged, the second rotating shaft is driven to receive the second cord, whereby to lift the bottom rail; when the second segment of the control cord is tugged, the second rotating shaft is driven to release the second cord, whereby to lower the bottom rail.

11. The top-down bottom-up window covering of claim 10, wherein, when the first segment of the control cord is tugged, the pre-stress unit accumulates the driving force; when the first segment of the control cord is dragged, the pre-stress unit releases the driving force to the first rotating shaft.

12. The top-down bottom-up window covering of claim 10, wherein, when the first segment of the control cord is dragged, the one-way clutch engages the lifting control structure and the first rotating shaft for lifting the middle rail; when the middle rail is pushed upward, the one-way clutch disengages the lifting control structure from the first rotating shaft so that the first rotating shaft is driven by the driving force released by the pre-stress unit to receive the first cord.

* * * * *